US010683634B2

(12) United States Patent
Cochran et al.

(10) Patent No.: US 10,683,634 B2
(45) Date of Patent: Jun. 16, 2020

(54) DEBRIS DIVERTER FOR MICROTRENCHERS

(71) Applicant: Coneqtec Corp., Wichita, KS (US)

(72) Inventors: Gary L. Cochran, Colwich, KS (US); William Andrew Cochran, Colwich, KS (US); David F. Voth, Derby, KS (US)

(73) Assignee: Coneqtec Corp., Wichita, KS (US)

( * ) Notice: Subject to any disclaimer, the term of this patent is extended or adjusted under 35 U.S.C. 154(b) by 96 days.

(21) Appl. No.: 16/138,038

(22) Filed: Sep. 21, 2018

(65) Prior Publication Data

US 2019/0136488 A1 May 9, 2019

Related U.S. Application Data

(60) Provisional application No. 62/561,933, filed on Sep. 22, 2017.

(51) Int. Cl.

| | |
|---|---|
| ***E02F 7/00*** | (2006.01) |
| ***E02F 5/08*** | (2006.01) |
| ***E01C 23/02*** | (2006.01) |
| ***E01C 23/09*** | (2006.01) |

(52) U.S. Cl.

CPC ..... *E02F 7/00* (2013.01); *E01C 23/025* (2013.01); *E01C 23/096* (2013.01); *E01C 23/0933* (2013.01); *E02F 5/08* (2013.01); *E01C 2301/50* (2013.01)

(58) Field of Classification Search

CPC .. E02F 7/00; E02F 5/08; E01C 23/025; E01C 23/0933; E01C 23/096; E01C 2301/50

USPC ..... 37/95

See application file for complete search history.

(56) References Cited

U.S. PATENT DOCUMENTS

| | | | | | |
|---|---|---|---|---|---|
| 5,092,658 | A * | 3/1992 | Smith | B28D 1/188 | 299/106 |
| 5,125,128 | A * | 6/1992 | Davis | E01H 1/0845 | 15/340.1 |
| 5,167,215 | A * | 12/1992 | Harding, Jr. | B23D 59/006 | 125/13.01 |
| 5,215,071 | A * | 6/1993 | Mertes et al. | B27B 9/02 | 125/13.01 |
| 5,415,495 | A * | 5/1995 | Johnson | E01C 23/088 | 404/84.05 |
| 5,908,224 | A * | 6/1999 | Santos | B24B 7/188 | 125/13.01 |
| 6,394,080 | B1 * | 5/2002 | Zavala | B28D 1/045 | 125/13.01 |

(Continued)

FOREIGN PATENT DOCUMENTS

| | | | | |
|---|---|---|---|---|
| DE | 3912885 | A1 * | 10/1990 | E01H 1/0872 |
| EP | 0869223 | A2 * | 10/1998 | E01C 23/088 |
| GB | 850946 | A * | 10/1960 | E01C 23/0946 |

*Primary Examiner* — Tara Mayo-Pinnock

(74) *Attorney, Agent, or Firm* — Woodard, Emhardt, Henry, Reeves & Wagner, LLP

(57) ABSTRACT

Arrangements for diverting and removing spoil created when a microtrench is being cut. The disclosed arrangements divert the debris and dust away from the microtrench during the cutting process. In optional embodiments, a spoil vacuum system is used to remove the dust particles during the debris diversion process. In further optional embodiments, a microtrench slot cleaning tool and slot vacuum system may be used. The microtrencher can be mounted on a skid-steer loader or a similar support vehicle.

20 Claims, 5 Drawing Sheets

(56) References Cited

U.S. PATENT DOCUMENTS

| | | | | |
|---|---|---|---|---|
| 6,454,490 | B1 * | 9/2002 | Murphy | E01C 23/0993 404/75 |
| 6,733,086 | B1 * | 5/2004 | McSharry et al. | E01C 23/088 299/64 |
| 8,381,711 | B2 * | 2/2013 | Loveless | B23D 59/006 125/13.01 |
| 2002/0139014 | A1 * | 10/2002 | Rivard | E02F 3/8825 37/355 |
| 2007/0096539 | A1 * | 5/2007 | Walker et al. | E01C 23/0933 299/39.3 |
| 2008/0008527 | A1 * | 1/2008 | Kraemer et al. | E01C 23/088 404/94 |
| 2012/0200140 | A1 * | 8/2012 | Nagasawa | B28D 1/045 299/39.3 |
| 2015/0218777 | A1 * | 8/2015 | Sewell et al. | E02F 3/241 37/352 |
| 2017/0101746 | A1 * | 4/2017 | Sewell | E01C 23/0933 |
| 2017/0350093 | A1 * | 12/2017 | Sewell | E02F 5/14 |

* cited by examiner

DEBRIS DIVERTER FOR MICROTRENCHERS

The present application claims priority to provisional application Ser. No. 62/561,933 filed on Sep. 22, 2017, which is incorporated by reference.

FIELD OF THE DISCLOSURE

The present disclosure relates to a microtrencher in the form of a radial saw for cutting a vertical channel or narrow slot trench into surfaces such as asphalt or concrete. The microtrencher includes a debris diverter allowing spoil from the cutting operation to be diverted and removed. It is described in the context of a representative system that is added to prime movers, such as skid-steer loaders.

BACKGROUND

In normal use, a skid-steer loader has a loader bucket pivotally attached to two front lift arms. Optionally, the loader bucket of a skid-steer loader may be removed and alternate or auxiliary implements such as a microtrencher may be attached to cut a trench in hard surfaces such as pavement surfaces of concrete or asphalt such as in roads, bridges or parking lots. A microtrench slot may be cut for instance with a radial saw, and may commonly have a depth in a range between approximately four to twelve inches. Microtrenches are often created and then wires or cables such as fiber optic cables are placed in the bottom of the trench. The trench is then filled with a sealant over the installed wires or cables.

The sealant may match or may be a different material from the prior surface material. For example, the sealant media may be a cold asphalt material or alternately may be formed using hot polymer, elasto-polymer or grout. Further, the sealant material has to be flexible enough to cope with corners on the route, crush resistant and sufficiently tough to cope with the pressure of the roadway above, which can reach 2900 psi. In certain situations, the microtrench must be dry and debris and dust free before the sealant can be installed in a manner which will properly bond with the inner microtrench sides and the surrounding surface material.

A currently common apparatus for cutting a microtrench uses a radial cutting saw mounted to the rear of a trenching machine. A substantial majority of the spoil from the cutting process remains in and immediately adjacent the cut. The spoil is a combination of debris and dust. Compressed air can be used to move the spoil, but that merely spreads the debris and dust over a larger area. To remove the debris and dust, in some arrangements a vacuum system is used consisting of a long hose with a nozzle wider than the trench placed above the trench and a large dedicated vacuum truck which immediately follows the trenching machine during use. In practice this is expensive and requires a large amount of space due to the presence of two different primary mover trucks/machines. This work is often done on roadways, which can cause traffic control problems. In practice, this arrangement often does not work well to remove the spoil because of the long distance that the heavy asphalt material must travel and the height to which the debris must be lifted in order to reach the vacuum truck collector.

SUMMARY

Example embodiments include a microtrencher which includes arrangements for diverting and removing spoil created when a microtrench is being cut. The spoil includes a combination of typically larger debris and dust particles. In certain aspects, the disclosed arrangement diverts the debris and dust away from the microtrench during the cutting process, depositing the debris through an exit gap. In certain optional embodiments, a vacuum system is used to remove the dust particles during the debris diversion process. In further optional embodiments, a microtrench slot cleaning tool may be used. The microtrencher can be mounted on a skid steer loader or a similar support vehicle.

An illustrative embodiment is an arrangement with a housing configured to move at a height along an asphalt or concrete cutting surface in a forward direction of travel. A radial planar blade with grinding teeth is rotatably mounted within the housing and arranged to cut a slot in the cutting surface as the housing is moved. The housing defines an exit opening aligned with the plane of the blade and arranged so that spoil created by the blade exits the housing through the exit opening. A plenum defining an entrance opening is mounted in communication with the housing exit opening. The plenum defines an enclosed plenum passage extending between plenum sides, a roof and a floor. The plenum passage extends forward from the entrance opening and then turns and extends laterally relative to the entrance opening and then terminates in an exit end. An end plate extends across the exit end of the plenum passage. A downward facing exit gap is defined adjacent to the exit end between a terminus of the plenum floor and the end plate, wherein the gap is laterally spaced away from the slot cut by the blade so that spoil travelling through the plenum passage is deposited through the exit gap laterally away from the slot.

In certain optional embodiments, the plenum floor is angled downward along at least portions of its length to assist in urging spoil toward the exit gap. Optionally, the arrangement may include a spoil vacuum system with a spoil vacuum intake arranged over one or more openings defined in the end plate and operable to capture lighter-than-air particles within the spoil while allowing debris such as heavier-than-air particles within the spoil to be deposited through the exit gap.

An alternate embodiment comprises an arrangement with a housing carried by a host machine vehicle along an asphalt or concrete cutting surface in a forward direction of travel. A radial planar blade with grinding teeth is rotatably mounted within the housing and arranged to cut a slot in the cutting surface as the housing is moved. The housing defines an exit opening on a forward side of the housing, wherein the exit opening is substantially aligned with the plane of the blade and arranged so that spoil created by the blade exits the housing through the exit opening. A plenum defining an entrance opening is mounted in communication with the housing exit opening. The plenum defines an enclosed plenum passage extending between plenum sides, a roof and a floor. The plenum passage extends forward from the entrance opening, extends laterally relative to the entrance opening and terminates in an exit end. An end plate extends across the exit end of the plenum passage. A downward facing exit gap is defined between a terminus of the plenum floor and the end plate, wherein the gap is laterally spaced away from the blade so that spoil travelling through the plenum passage is deposited through the exit gap laterally away from the slot.

Optionally, the arrangement may include a slot cleaning tool carried by the host machine vehicle and connected to a slot tool vacuum intake of a slot vacuum system. The slot cleaning tool may be formed of a series of longitudinal hollow chambers arranged in parallel along a plane configured to be lowered into a vertical slot cut by the blade. The series of chambers define a series of openings staggered along the height of the chambers. Some may be side openings while other openings are downward facing.

Further forms, objects, features, aspects, benefits, advantages, and examples of the present disclosure will become apparent from a detailed description and drawings provided herewith.

DESCRIPTION OF SELECTED EXAMPLES

Figure 1:
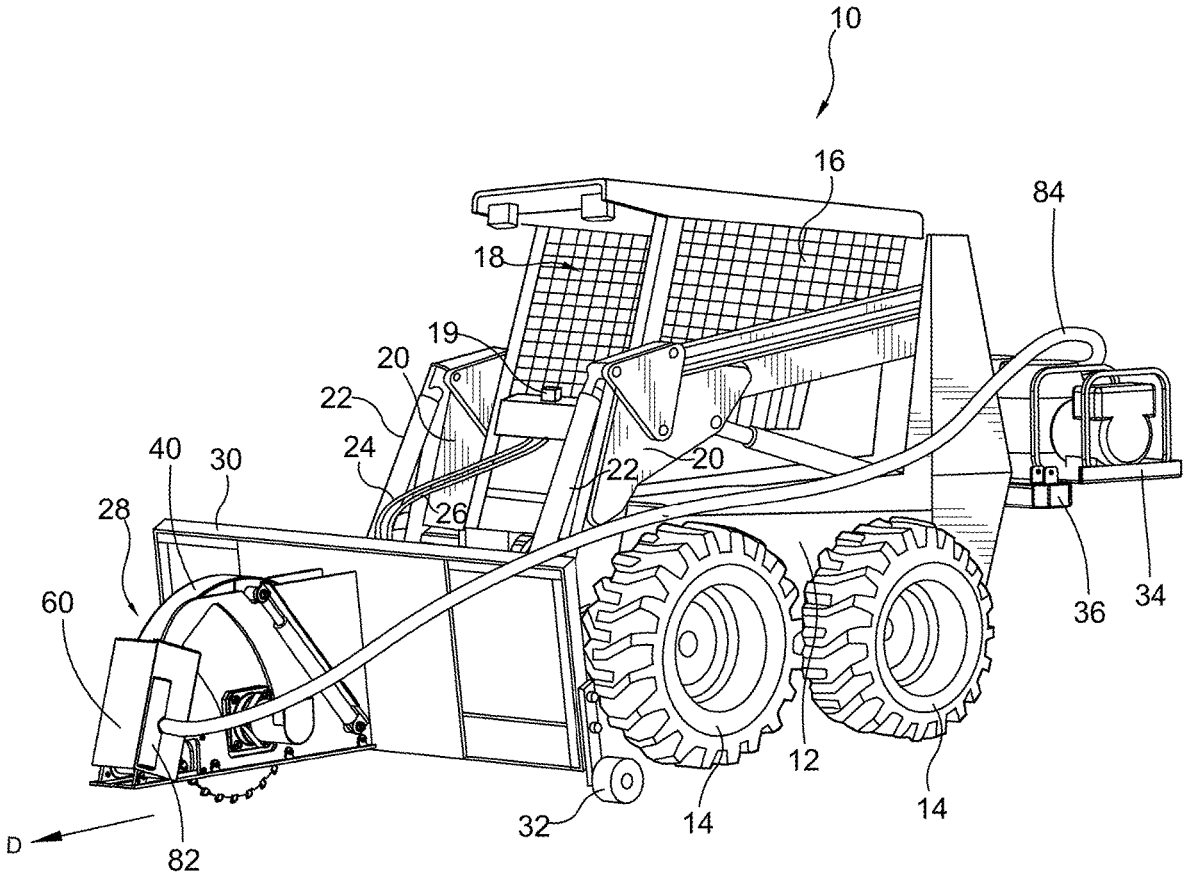
FIG. 1 is a perspective view of a representative arrangement with a microtrencher attached to a skid-steer loader.
Figure 2:
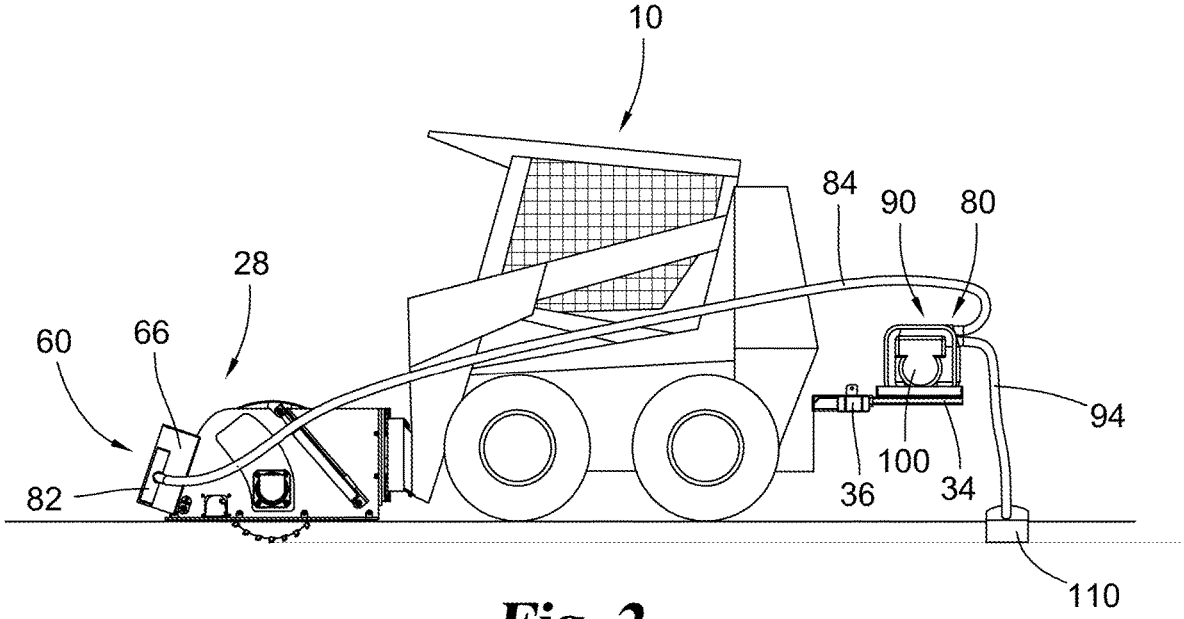
FIG. 2 is a side view of a skid-steer loader with a microtrencher and the optional inclusion of a slot cleaning tool and vacuum systems.
Figure 3:
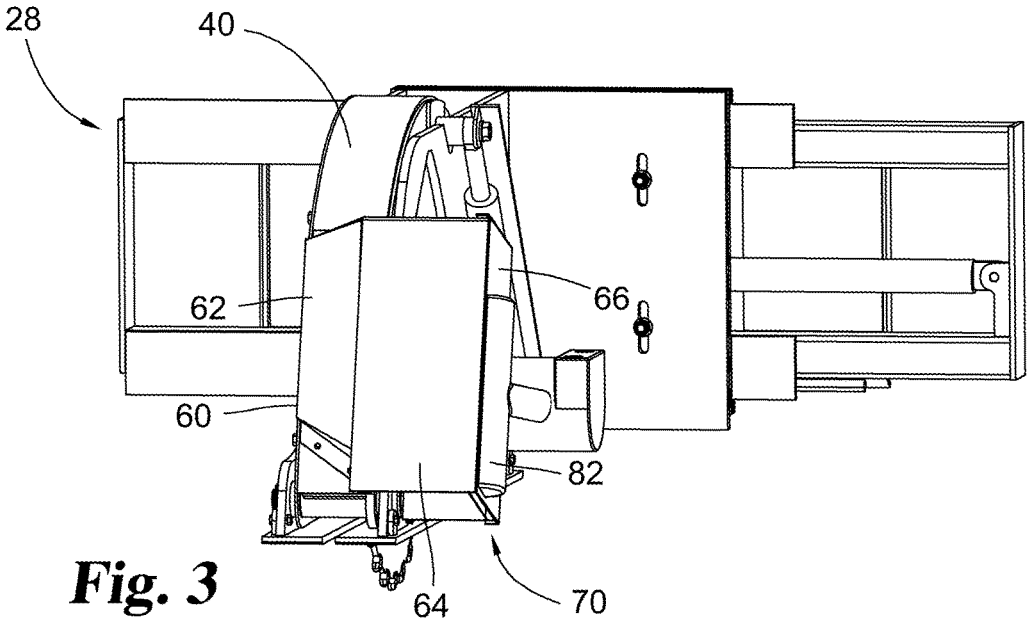
FIG. 3 is a front perspective view of an example microtrencher arrangement of FIG. 1.
Figure 4:
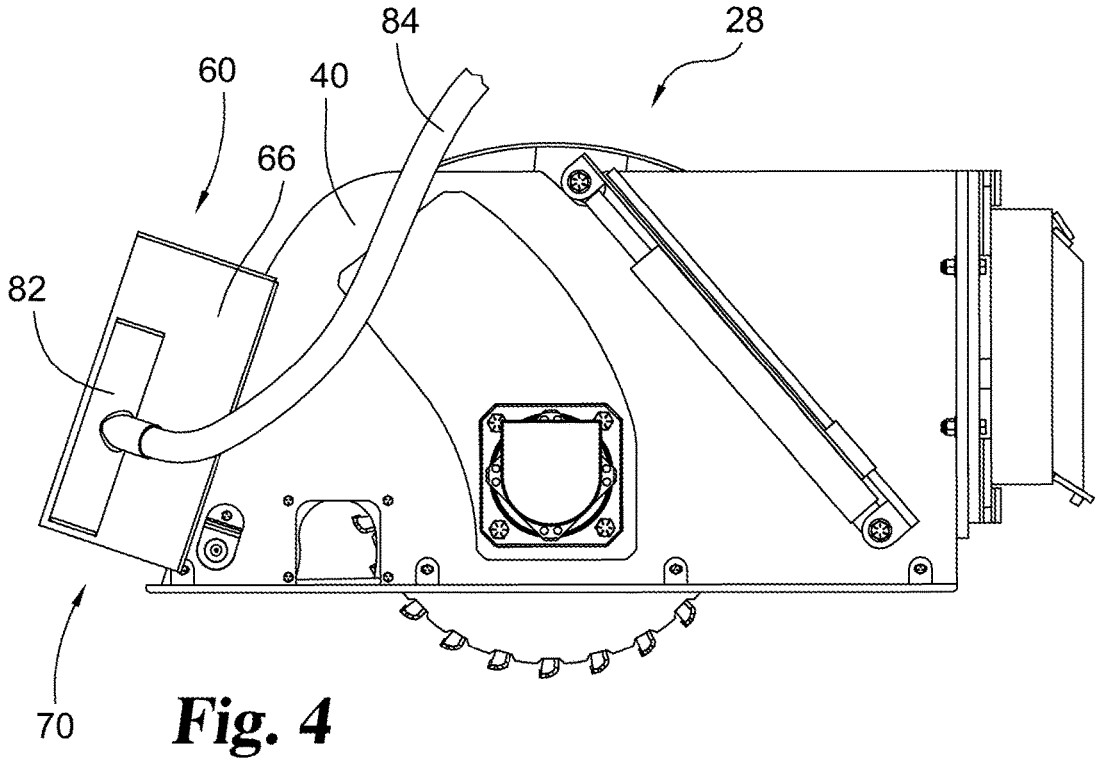
FIG. 4 is a side view of the microtrencher arrangement of FIG. 3.

For the purpose of promoting an understanding of the principles of the disclosure, reference will now be made to the examples illustrated in the drawings and specific language will be used to describe the same. It will nevertheless be understood that no limitation of the scope of the disclosure is thereby intended. Any alterations and further modifications in the described examples, and any further applications of the principles of the disclosure as described herein are contemplated as would normally occur to one skilled in the art to which the disclosure relates. Certain examples of the disclosure are shown in detail; although it will be apparent to those skilled in the relevant art that some features which are not relevant to the present disclosure may not be shown for the sake of clarity.

An example embodiment includes a microtrencher arrangement which include a system for diverting and removing spoil created when a microtrench slot is being cut. The spoil includes a combination of typically larger heavier-than-air pieces generally referred to herein as debris and lighter particles which may be temporarily suspended to travel or floating through the air, generally referred to herein as dust. In certain aspects, the disclosed arrangements divert the debris and dust away from the microtrench during the cutting process. In certain optional embodiments, a vacuum system is used to remove the dust particles during the spoil diversion process. In further optional embodiments, a microtrench slot cleaning tool may be used. The microtrencher can be mounted on a skid steer loader or a similar support vehicle.

Referring generally to FIG. 1 there is shown a skid steer loader as an example support vehicle with a representative microtrencher 28. A typical skid steer loader 10 is a type of support vehicle having a frame 12, four wheels 14 or tracks, an operator position, such as a cage or cab 16 with a seat 18, and a pair of left and right front lift arms 20. Left and right hydraulic cylinders 22 may be paired with lift anus 20. Various work tool implements may be interchangeably mounted to the skid steer loader, for example by being coupled and uncoupled from the lift arms 20.

As illustrated, an implement frame 30 is generally configured to be mounted to the left and right arms 20 of the skid steer loader and optionally the left and right hydraulic cylinders 22. In a preferred embodiment, brackets are provided at the rear of the frame allowing the frame and microtrencher 28 to be attached to the lift arms 20 and/or cylinders 22. Left and right arms 20 and the left and right hydraulic cylinders 22 may function in concert to pivot the orientation of frame 30 and the microtrencher. In a preferred embodiment, frame 30 is configured as a lateral piece, which may function as a debris shield and which may allow the microtrencher to be mounted or moved to the left or right of the centerline of the skid-steer loader in the direction of travel D if desired. Optionally ground engaging elements such as rollers 32 are mounted adjacent the foot of the frame 30 to allow the frame to rest upon and roll over a support surface.

The skid-steer loader 10 may have a hydraulic power system, which may be selectively coupled directly or through an interface to certain work implements to provide hydraulic power to the implements. Example supply and return lines 24, 26 to microtrencher 28 are shown. Generally the skid steer loader and any work implements are controlled by an operator through controls 19 located adjacent the operator position. In some skid steer loaders, the operator enters the operator position from the front of the vehicle.

Figure 5:
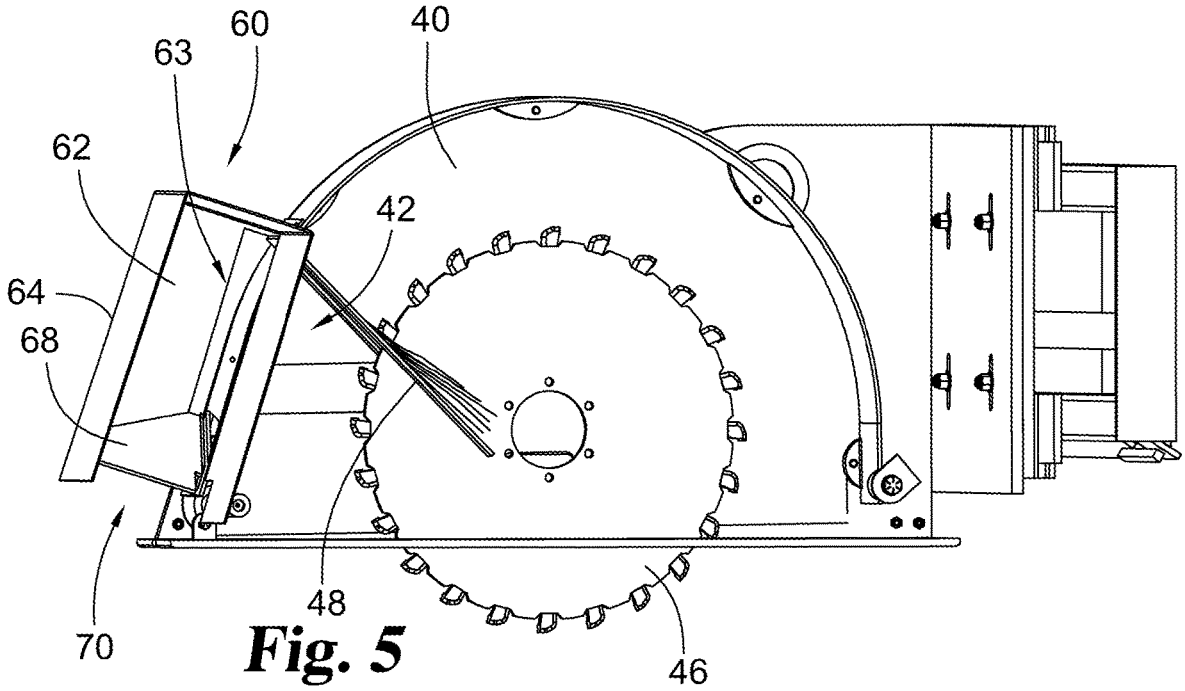
FIG. 5 is a side perspective view of the microtrencher arrangement of FIG. 3 with the exit plate removed and showing the interior of the microtrencher.
Figure 6:
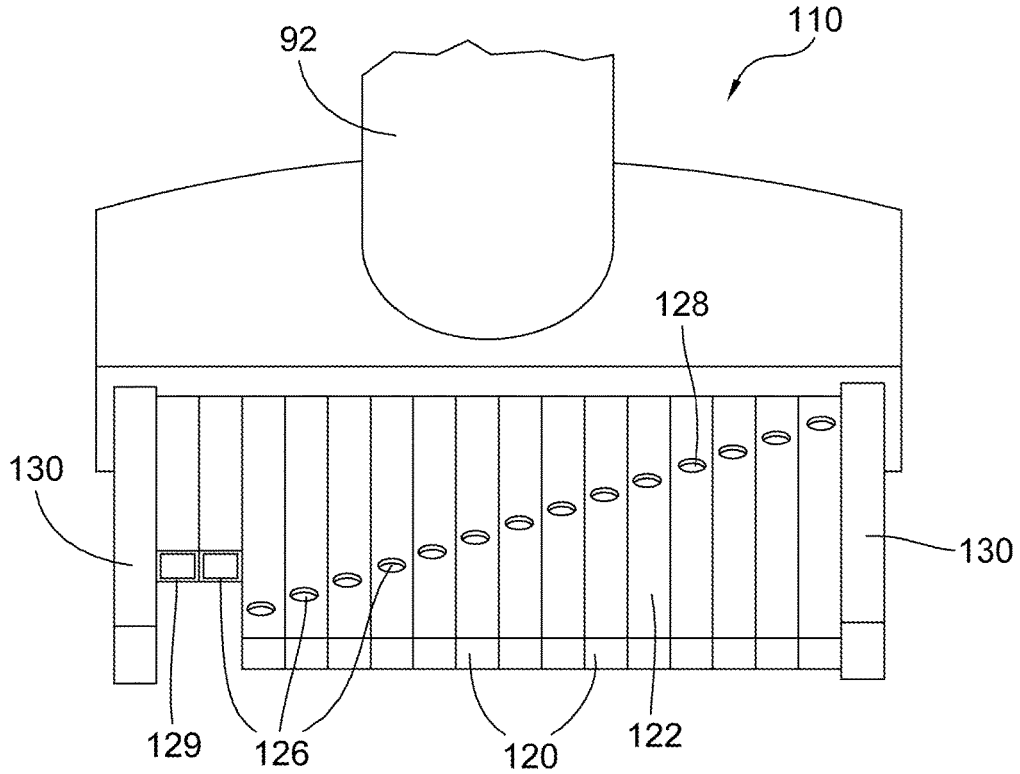
FIG. 6 is a perspective view of an embodiment of a slot cleaning tool.
Figure 7:
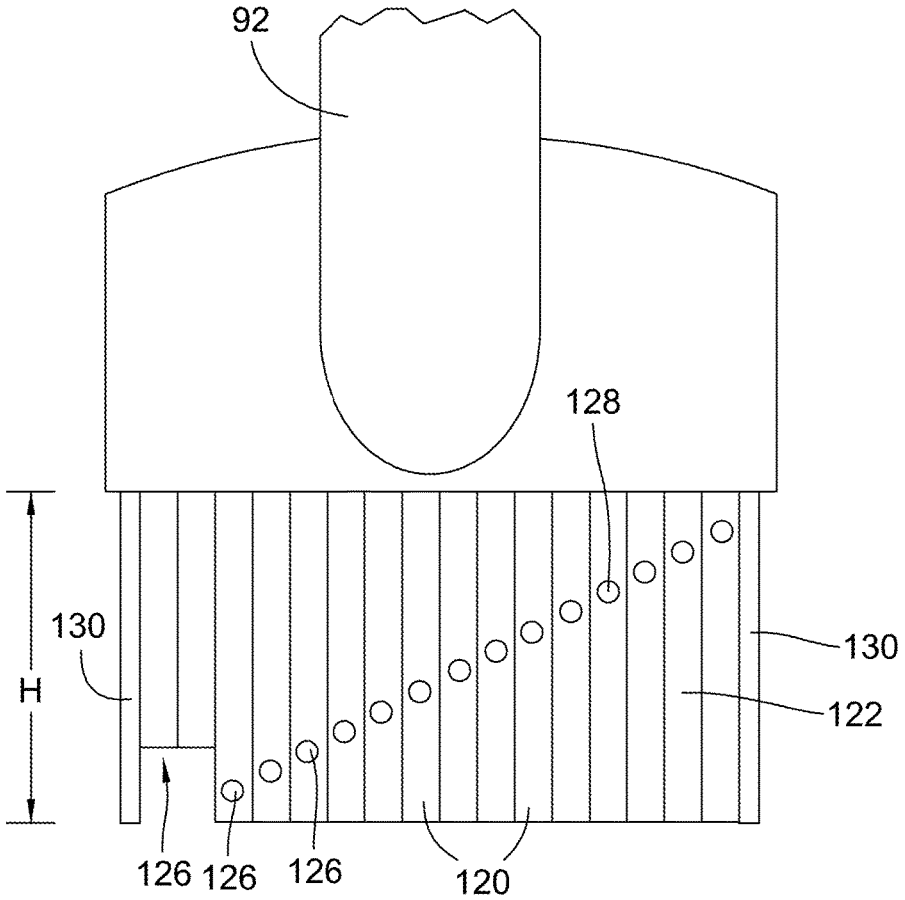
FIG. 7 is a side view of the slot cleaning tool of FIG. 6.

Certain embodiments include a rotating cutting tool such as a microtrencher. Other embodiments may be used in conjunction with other types of tools which involve dust and debris, such as cold planers, slot cutters, milling machines or power brooms for asphalt or concrete. Microtrencher 28 in FIGS. 1-5 is representative and shown with housing 40 mounted to a support vehicle such as skid steer loader 10. In certain embodiments, microtrencher 28 is based on a hydraulically powered radial substantially planar saw blade 46 with grinding teeth for cutting asphalt or concrete. The grinding teeth may be replaceable, such as carbide tipped cutting pieces. Optionally, certain grinding teeth may be offset mounted to the blade to cut a wider slot. The shaft or axle of the blade is typically parallel to the cutting surface. The interior of housing 40 is illustrated in FIG. 5. The circular blade 46 is located within a housing or shield 40 which is level or angled and may be configured to move at a uniform height along or above a cutting surface in a direction of travel. In some embodiments, housing 40 may include a base piece and a pivoting piece. The blade 46 and a portion of housing 40 may be pivotally mounted to selectively rise and fall during use, using a plunge cut motion to reach a desired depth. In the illustrated embodiment, the exterior of housing 40 is semi-circular in shape with a curved interior and exterior profile. In the representative embodiment, the exterior of housing 40 generally has a curved forward facing portion, a curved rearward portion and a curved upper portion extending between the forward facing portion and the rear portion.

As the microtrencher 28 is moved, the blade 46 cuts a narrow trench or slot in the asphalt or concrete cutting surface. A microtrench commonly has a slot depth of less than one foot, for instance in a range between approximately four and twelve inches and a width in a range of approximately 0.5 to 1.5 inches. In certain embodiments, microtrenchers may be made to cut a maximum depth of six or twelve inches. The microtrenchers may incorporate a depth gauge to measure and control the applied cut depth during use. These dimensions are representative and not intended to be limiting. Different municipalities have different microtrench requirements.

The microtrencher 28 may be mounted on a host machine vehicle or primary mover, such as via frame 30 to skid-steer loader 10, or it may operate independently, for example when mounted to an independent frame or trolley. The primary mover or host machine vehicle and frame are used independently or in cooperation to control the cutting depth of the microtrencher. In certain embodiments, the microtrencher housing 40 is mounted to a support frame 30 which supports housing 40 at a desired height to control the cutting depth of the blade and which is movable to move the housing and blade along the surface to be cut in the direction of travel D. Housing 40 may include a base piece with skids that straddle the path of blade 46, with blade 46 passing closely between the skids. The skids or skid shoes press against the cutting surface, and may be adjusted or changed with each blade width. Skids are used in controlling the cut depth and also support the asphalt directly adjacent to the cut by holding it down and in place. Since the blade is cutting in an upward direction, the skids keep the material edges from chunking out. This helps provide a clean edge at the sides of the cut.

In the illustrated embodiment, microtrencher 28 has a spoil chute mounted to and extending from the housing. The spoil chute includes plenum 60. Plenum 60 defines an entrance opening 63 which is mounted in communication with an exit opening 42 defined in housing 40. Preferably there are no gaps for spoil to escape between housing 40 and plenum 60. The housing exit opening 42 is aligned with the plane of blade 46. In some embodiments, exit opening 42 is a vertical slot through the housing. In the illustrated embodiment, exit opening 42 is defined in the forward portion of housing 40. Plenum 60 has portion 62 extending forward from the entrance opening and which then turns to the side. Portion 62 may define an approximate right angle or a curve or may be slanted or angled. In the illustrated embodiment a front side portion 62 is angled forward and laterally, forming a ramp which helps divert and deflect forward momentum of the spoil converting it to lateral momentum.

Portion 64 of plenum 60 extends laterally to an exit end which may be closed, for instance with an exit plate 66. Exit plate 66 may be integral with other portions of plenum 60 or may be a separate piece which is assembled across the exit end. The exit plate and/or exit end is optionally openable for cleaning and maintenance. Exit plate 66 is not shown in FIG. 5 for purposes of illustration. The plenum is enclosed and substantially sealed along its length by side panels, a roof and a floor, defining a plenum passage. The floor 68 of the plenum 60 extends forward in the forward extending portion 62 and extends laterally in the lateral portion 64 toward the exit end. The plenum floor 68 terminates before extending to exit plate 66. The spacing between the lateral terminus of floor 68 and exit plate 66 defines a downward facing exit gap 70. Optionally, the plenum floor 68 may be angled downward along all or portions of its length to assist in urging spoil toward exit gap 70.

In operation, spoil created by blade 46 exits housing 40 through opening 42 and enters the spoil chute through entrance opening 63. As illustrated in the interior view in FIG. 5, optionally housing 40 may incorporate a removal brush 48 which assists in filtering and urging spoil into opening 42 and minimizes spoil from falling back toward the cut. Brush 48 may be formed of a plurality of bristles which are anchored adjacent the upper end of opening 42 and extend toward blade 46. Blade 46 passes between the bristles during use. The brush bristles may be made of a nylon, a plastic or a similar durable material.

The spoil is then urged forwardly and laterally along the length of plenum 60, so that the spoil eventually exits through exit gap 70 and is deposited away from the blade. The spoil may be urged through plenum 60 in part by the pressure of an air stream created by the rotation of blade 46.

In certain embodiments, an optional spoil vacuum system 80 is connected to and works in cooperation with the plenum. When used, vacuum system 80 helps pull spoil toward the exit end and helps remove dust from plenum 60. Vacuum system 80 includes a vacuum pump for drawing air through hose 84. The dust is then captured and stored in vacuum machine 86, for instance in a storage tank, until it is disposed of. Vacuum system 80 may be carried by the same host machine vehicle as microtrencher 28.

In these embodiments, the exit end defines one or more openings or a series of openings in communication between the interior volume of the plenum and the exterior of the plenum. For instance, the openings may be defined in exit plate 66. A spoil vacuum intake 82 is arranged and sealed over the openings. Spoil vacuum intake 82 is connected to a hose 84 which extends to vacuum machine 86. In this embodiment, spoil vacuum system 80 may capture a significant portion of the lighter-than-air dust particles of the spoil which float or travel in the air. The heavier-than-air debris in the spoil remains and exits downward through exit gap 70. The deposited debris is laterally spaced from the slot cut by the blade. The deposited heavier-than-air debris may be later removed, for example with a street sweeping machine or broom.

In alternate embodiments, a misting system is connected to and works in cooperation with the spoil chute. In these embodiments, one or more openings are defined in the plenum walls, roof and/or exit plate and misting nozzles are mounted through the openings. In operation, the nozzles dispense water mist into plenum 60 to capture and remove dust particles from the air, causing the particles to exit downward through gap 70. Other embodiments may use a liquid such as oil for dust remission.

Selected embodiments of the disclosure include a slot cleaning tool 110. The slot cleaning tool 110 may operate in combination with the microtrencher and spoil chute, or optionally may be operated separately after a microtrench has been cut. In some arrangements, slot cleaning tool 110 is mounted to the host machine/primary mover and arranged to travel forward within the slot with movement of the primary mover to automatically clean a slot as the slot is cut. In other embodiments, slot cleaning tool 110 may be used manually.

Slot cleaning tool 110 is formed of a series of longitudinal hollow chambers 120. The chambers 120 are arranged in parallel along a plane. Chambers 120 are illustrated as rectangular, but other cross-sectional shapes may be used as desired. Tool 110 defines a height H at least tall enough to extend into the depth of the microtrench slot to be cleaned. The heights of the chambers may not all be equal. In use, the chambers are arranged in a plane which can be oriented and lowered into a vertical slot to the depth of the slot. The chambers 120 have a pair of outward facing opposing sides 122 that face the inward walls of the slot.

A series of openings 126 is defined from the exterior into the hollow chamber interiors. The series of openings corresponds to the series of chambers. The openings are staggered along the height of the series of chambers, preferably with at least one opening corresponding to each height within the microtrench slot. Certain openings may partially overlap in height. For at least one and optionally most chambers, one or more side openings 128 face the slot walls, with the center axis of each side opening substantially perpendicular to the plane of the chambers, and thus perpendicular to the slot walls during use. In some embodiments, a chamber may have a pair of side openings 128 defined through a pair of outward facing opposing sides 122. The chambers 120 with side openings 128 may have closed lower ends. One or more chambers 120 may define end openings 129 which face downward within the slot thus facing the floor of the slot.

In certain embodiments, tool 110 includes a pair of forward and rearward guides 130 bracketing forward and rearward ends of the series of chambers. The forward and rearward guides 130 form forward and rearward edges of tool 110. The forward and rearward guides 130 may have a width sized to substantially span the width of the microtrench slot, while allowing tool 110 to slidably move along the length of the slot. The guides 130 are preferably formed of a low-friction yet durable material which does not easily bind with the slot sides or wear. In certain embodiments, the width of the hollow chambers 120 is less than the width of the slot and less than the width of guides 130, creating a slight space or gap between the chambers and the slot walls on one or both sides. For chambers 120 which define end openings 129, the chamber height may be slightly spaced above the slot floor. The spacing may assist in allowing clearance space for air and dust removal.

The upper portion of tool 110 is connected to a slot tool vacuum intake 92 of slot vacuum system 90. Vacuum system 90 includes vacuum machine 96 with a vacuum pump for drawing air through hose 94. The dust is then captured and stored, for instance in a storage tank, until it is disposed of. Vacuum intake 92 feeds hose 94 which extends to vacuum machine 96. In selected alternate embodiments, vacuum system 90 can be configured as blower with hose 94 supplying compressed air to tool 110 or a nozzle accessory which can be used to blow spoil out of and away from the microtrench. In certain embodiments slot vacuum machine 96 may be separate from spoil vacuum machine 86. In other embodiments, vacuum systems 80 and 90 may share a vacuum machine and/or storage tank, with different ports for hoses 84 and 94.

In use, tool 110 is arranged and inserted into a slot so that the series of chambers 120 are vertically arranged along a plane along the length of the slot. When vacuum is applied to the upper ends of the chambers 120, air, dust and debris are drawn into the chambers through the side openings 128 to clean the slot walls. Air, dust and debris are also drawn into certain chambers through bottom openings 129 to clean the slot floor. The openings 126 are preferably staggered yet create a continuous pattern corresponding to the height of the slot. Tool 110 is then slid forward or rearward within the slot. As tool 110 slides within the slot, the pattern of openings 126 removes remaining spoil from the slot floor as well as along the height of the slot walls. The spoil is transported to vacuum machine 96 for later removal.

Figure 8:
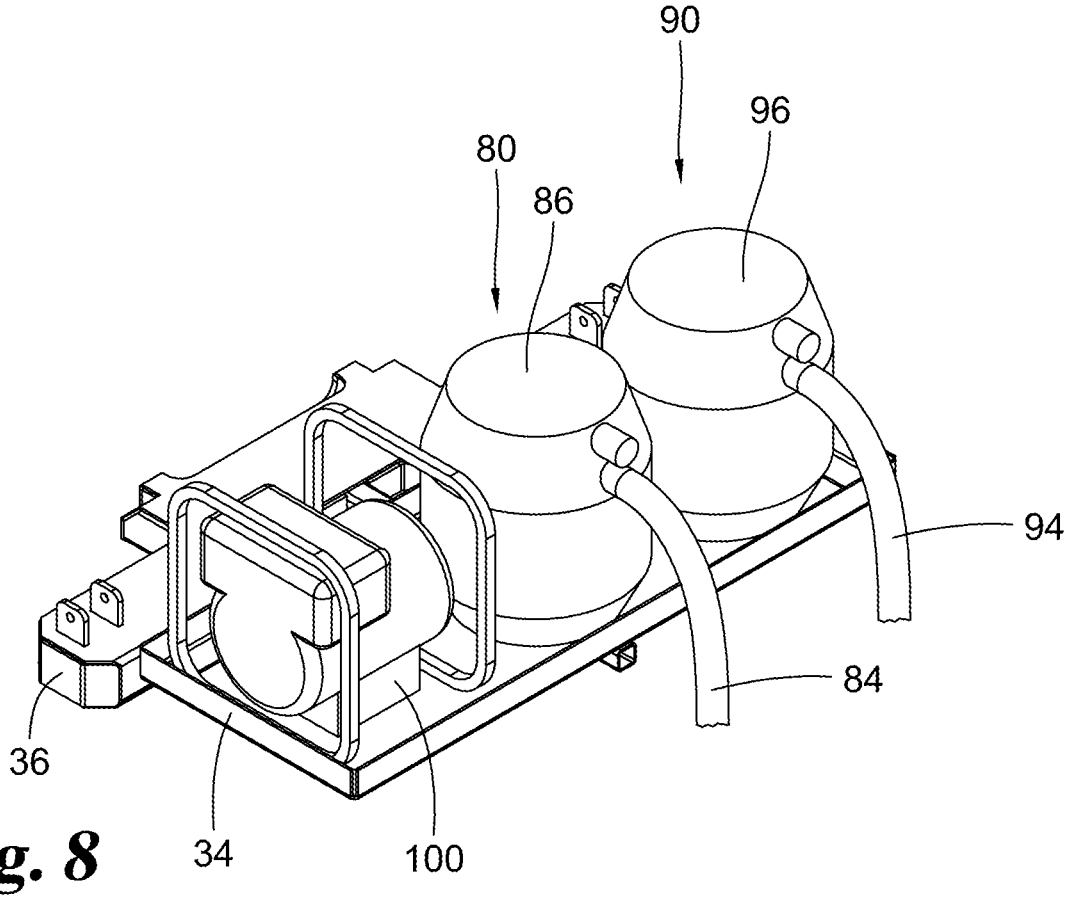
FIG. 8 is a representative view of a support shelf for vacuum machines and a generator which can be mounted to a prime mover.

Vacuum systems 80 and 90 may be carried by the prime mover, or alternately can be on separate movable carts or vehicles. The vacuum systems 80 and 90 may be powered by the primary mover power supply, or by alternate power supplies such as generator 100. FIG. 8 illustrates a support shelf 34 mountable to a prime mover bumper 36 or trailer hitch as a representative example of a location for vacuum machines 86 and 96 and generator 100 to be supported and carried by a prime mover. Vacuum systems 80 and 90 may be relatively small portable units, such as are commonly sold as wet/dry vacuums.

While the disclosure has been illustrated and described in detail in the drawings and foregoing description, the same is to be considered as illustrative and not restrictive in character, it being understood that only the preferred example has been shown and described and that all changes, equivalents, and modifications that come within the spirit of the disclosures defined by following claims are desired to be protected.

What is claimed:

1. An arrangement, comprising:

a. a housing configured to move at a height along an asphalt or concrete cutting surface in a forward direction of travel;

b. a radial planar blade with grinding teeth rotatably mounted within the housing and arranged to cut a slot in the cutting surface as the housing is moved;

c. the housing defining an exit opening aligned with the plane of the blade and arranged so that spoil created by the blade exits the housing through the exit opening;

d. a plenum defining an entrance opening mounted in communication with the housing exit opening;

e. the plenum defining an enclosed plenum passage extending between plenum sides, a roof and a floor;

f. the plenum passage extending forward from the entrance opening, extending laterally relative to the entrance opening and terminating in an exit end, g. an end plate extending across the exit end of the plenum passage; and, h. a downward facing exit gap defined between a terminus of the plenum floor and the end plate, wherein the exit gap is laterally spaced away from the blade so that spoil travelling through the plenum passage is deposited through the exit gap laterally away from the slot.

2. The arrangement of claim 1, wherein the plenum floor is angled downward along at least portions of its length to assist in urging spoil toward the exit gap.

3. The arrangement of claim 1, wherein a front side portion of the plenum passage is angled forward and laterally to deflect forward momentum of the spoil to lateral momentum.

4. The arrangement of claim 1, comprising a spoil vacuum system including a vacuum intake arranged over one or more openings defined in the end plate and operable to capture lighter-than-air particles within the spoil while allowing heavier-than-air particles within the spoil to be deposited through the exit gap.

5. The arrangement of claim 4, wherein the housing and the spoil vacuum system are carried by the same host machine.

6. The arrangement of claim 1, comprising a removal brush mounted within the housing and arranged so that the blade passes between bristles of the brush during use, wherein the brush urges spoil into the exit opening.

7. The arrangement of claim 6, wherein the brush bristles are anchored adjacent an upper end of the exit opening and extend toward the blade.

8. The arrangement of claim 1, wherein the housing comprises a base piece with skids, with the blade passing closely between the skids, wherein the skids hold the cutting surface adjacent the blade in place during operation of the blade.

9. An arrangement, comprising:

a. a housing carried by a host machine vehicle along an asphalt or concrete cutting surface in a forward direction of travel;

b. a radial planar blade with grinding teeth rotatably mounted within the housing and arranged to cut a slot in the cutting surface as the housing is moved;

c. the housing defining an exit opening on a forward side of the housing, wherein the exit opening is substantially aligned with the plane of the blade and arranged so that spoil created by the blade exits the housing through the exit opening;

d. a plenum defining an entrance opening mounted in communication with the housing exit opening;

e. the plenum defining an enclosed plenum passage extending between plenum sides, a roof and a floor;

f. the plenum passage extending forward from the entrance opening, extending laterally relative to the entrance opening and terminating in an exit end, g. an end plate extending across the exit end of the plenum passage; and, h. a downward facing exit gap defined between the plenum floor and the end plate, wherein the exit gap is laterally spaced away from the blade so that spoil travelling through the plenum passage is deposited through the exit gap laterally away from the slot.

10. The arrangement of claim 9, comprising a spoil vacuum system carried by the host machine vehicle including a spoil vacuum intake arranged over one or more openings defined in the end plate and operable to capture lighter-than-air dust particles within the spoil while allowing heavier-than-air debris within the spoil to be deposited through the exit gap.

11. The arrangement of claim 9, comprising a slot cleaning tool carried by the host machine vehicle and connected to a slot tool vacuum intake of a slot vacuum system, the slot cleaning tool being formed of a series of longitudinal hollow chambers arranged in parallel along a plane configured to be lowered into a vertical slot cut by the blade, wherein the series of chambers define a series of openings staggered along the height of the series of chambers.

12. The arrangement of claim 11, wherein the slot cleaning tool is arranged to automatically travel forward within the slot with movement of the host machine vehicle during use.

13. The arrangement of claim 11, wherein the series of openings defines at least one side opening, with the axis of the side opening substantially perpendicular to the plane defined by the hollow chambers.

14. The arrangement of claim 13, wherein at least one chamber defines a pair of side openings on opposite sides of the plane defined by the hollow chambers.

15. The arrangement of claim 13, wherein at least one chamber defines an end opening which faces downward within the slot.

16. An arrangement, comprising:

a. a housing configured to move along an asphalt or concrete cutting surface in a forward direction of travel;

b. a rotating cutting tool with grinding teeth rotatably mounted within the housing and arranged to cut the cutting surface as the housing is moved;

c. the housing defining an exit opening arranged so that spoil created by the cutting tool exits the housing through the exit opening;

d. a plenum defining an entrance opening mounted in communication with the housing exit opening;

e. the plenum defining an enclosed plenum passage extending between plenum sides, a roof and a floor;

f. the plenum passage extending forward and laterally from the entrance opening and terminating in a closed exit end; and, g. a downward facing exit gap defined between a terminus of the plenum floor and the exit end, wherein the gap is laterally spaced away from the blade so that spoil travelling through the plenum passage is deposited downward through the exit gap laterally away from the slot.

17. The arrangement of claim 16, wherein the plenum floor is angled downward along its length to assist in urging spoil toward the exit gap.

18. The arrangement of claim 16, wherein a front side portion of the plenum passage is angled forward and laterally to deflect and convert forward momentum of the spoil to lateral momentum.

19. The arrangement of claim 16, comprising a spoil vacuum system including a vacuum intake arranged over one or more openings defined in the exit end and operable to capture lighter-than-air dust particles within the spoil while allowing heavier-than-air debris within the spoil to be deposited through the exit gap.

20. The arrangement of claim 16, comprising a removal brush mounted within the housing and arranged so that the cutting tool passes between bristles of the brush during use, wherein the brush urges spoil into the exit opening.

* * * * *